US006614355B1

(12) United States Patent
Wagner et al.

(10) Patent No.: US 6,614,355 B1
(45) Date of Patent: Sep. 2, 2003

(54) SYSTEM AND METHOD FOR SAMPLING AN AC SWITCH

(75) Inventors: Phillip Ryan Wagner, Baltimore, OH (US); John Gilman Chapman, Jr., Delaware, OH (US)

(73) Assignee: Ranco Incorporated of Delaware, Wilmington, DE (US)

( * ) Notice: Subject to any disclaimer, the term of this patent is extended or adjusted under 35 U.S.C. 154(b) by 0 days.

(21) Appl. No.: 09/983,634

(22) Filed: Oct. 25, 2001

Related U.S. Application Data

(60) Provisional application No. 60/289,800, filed on May 10, 2001.

(51) Int. Cl.[7] ..... G08B 21/00

(52) U.S. Cl. ..... 340/644; 307/131; 361/93.1; 702/64

(58) Field of Search ..... 340/644, 657, 340/664; 324/76.11, 133; 702/64; 361/87, 93.1; 307/128, 131

(56) References Cited

U.S. PATENT DOCUMENTS 5,023,816 A * 6/1991 Patton et al. ..... 700/286
5,229,651 A * 7/1993 Baxter, Jr. et al. ..... 307/66
5,544,065 A * 8/1996 Engel et al. ..... 702/75
2002/0080542 A1 * 6/2002 Mendoza et al. ..... 361/90

* cited by examiner

*Primary Examiner*—Thomas Mullen
(74) *Attorney, Agent, or Firm*—Leydig, Voit & Mayer, Ltd.

(57) ABSTRACT

A microcontroller (122) uses a two-stage algorithm to sample the state of an AC switch (124) connected directly to an input pin (126). An AC line signal (102) is sampled by a pre-filtering routine that samples the AC line signal (102) to determine when a peak or trough is occurring and generates a trigger signal at or near the occurrence of a peak or trough. By basing the triggering signal on the state of the AC line signal (102), the triggering signal is independent of any shift of the phase angle of the AC line signal (102) and the microcontroller's operating clock (152). A switch sampling routine (204) is initiated at each occurrence of the triggering signal which samples the state of the AC switch (124). Successive sampled values are shifted into a shift register (150) on the microcontroller (122). Another routine (208) is periodically initiated by the functional software of the microcontroller (122) to update a flag, indicating the status of the AC switch (124), based on the contents of the shift register (150).

28 Claims, 6 Drawing Sheets

SYSTEM AND METHOD FOR SAMPLING AN AC SWITCH

RELATED APPLICATIONS

This application relates to and claims priority from U.S. application Ser. No. 60/289,800 filed May 10, 2001 entitled AC SWITCH SAMPLING FILTER FOR MICROCONTROLLERS, the disclosure of which is hereby incorporated in its entirety by reference.

TECHNICAL FIELD

The present invention relates to input sampling and more particularly, to sampling an alternating current (AC) input.

BACKGROUND ART

Detecting the presence of an alternating current (AC) signal with digital equipment is much more difficult than merely determining if a direct current (DC) voltage level is present on an input line. Apparatus and techniques for detecting the presence of an AC signal, or stated another way—detecting the state of an AC switch, have typically included complicated sensing, filtering, and calculating circuitry and procedures.

Because an AC signal has periods in which its voltage level would be detected as a "0" or logic low, simply sampling the AC signal periodically is not an option because a number of false negatives will occur even if an AC signal is present. One solution is to try to perform the sampling of the AC signal only while the signal is at or near its peak. However, to do so would require synchronization between the AC signal's frequency and the operating clock of the digital sampling equipment. Especially for an AC signal such as the standard residential AC power signal, the variability of the timing of the AC power signal will cause apparent phase shifting with any digital sampling equipment operating with more precise clock timing. Thus, even if the frequency of the AC signal is known and the first sampling of the AC signal occurs at a peak, the drift of the AC signal will eventually cause sampling to occur at times other than the AC signal peaks.

Adding peak detection circuitry or zero-crossing circuitry, which increases the complexity and cost of the sampling device, is one solution to ensure that the AC signal is sampled only at its peaks.

Currently, there is an unmet need for digital sampling methods and devices that detect the state of an AC switch while minimizing external filtering and conditioning components and that are insensitive to phase skewing between the AC signal and an operating clock.

DISCLOSURE OF INVENTION

The present invention addresses and meets these and other needs by pre-filtering an AC line signal to generate a trigger for sampling an AC signal, and filtering the sampled AC signal in such a manner so as to provide an adjustable hysteresis when determining whether or not the sampled signal is present and so as to provide immunity from false determinations.

In particular, one aspect of the present invention relates to a method for detecting the presence of one or more AC signals on a respective line. According to this aspect of the invention, for each of the particular AC signals and their respective line, a trigger signal is received that corresponds to a trough or a peak of the particular AC signal; the respective line is sampled to generate a binary value; and this generated binary value is combined with previously generated binary values for the respective line. Based on the combination of binary values, a determination is made whether the particular AC signal is present on the respective line.

Another aspect of the present invention relates to a method for providing a trigger signal that is synchronized with an AC signal being sensed. According to this aspect of the invention, a first line connected with the AC signal is sensed to determine if its state corresponds to logical HIGH or logical LOW. If the state corresponds to LOW, then a first counter is incremented but only if doing so will not make it exceed a certain value. If, however, the state corresponds to HIGH, then a second counter is incremented but only if doing so will not make it exceed the certain value. Finally, when both the first and second counters are equal and they also equal that certain value, the trigger signal is generated.

A still further aspect of the present invention relates to a device that detects the state of an AC switch. According to this aspect of the invention, the device includes an input that is connected with an input line and this input line is switchably connected with an AC signal through the AC switch. The device also includes circuitry for generating a trigger signal that corresponds to a trough or peak of the AC signal; circuitry for sensing a current logical level at the first input; and a memory that stores a combination of this current sensed level as well as previously sensed logical levels. Furthermore, this device includes a comparator that compares the combination of logical levels with a threshold to determine if the AC signal is present on the input line. This determination is analogous to determining the state of the AC switch.

Still other objects and advantages of the present invention will become readily apparent from the following detailed description, simply by way of illustration of the best mode contemplated of carrying out the invention. As will be realized, the invention is capable of other and different embodiments and its several details are capable of modifications in various obvious respects, all without departing from the invention. Accordingly, the drawings and description are to be regarded as illustrative in nature, and not as restrictive.

BRIEF DESCRIPTION OF DRAWINGS

The present invention is illustrated by way of example, and not by way of limitation, in the figures of the accompanying drawings and in which like reference numerals refer to similar elements and in which.

BEST MODE FOR CARRYING OUT THE INVENTION AND INDUSTRIAL APPLICABILITY

To aid with the understanding of the present invention, exemplary embodiments are presented within the context of a specific environment involving detection of an AC switch's state in the context of the equipment and AC signals in a residential setting. In general, however, the invention is applicable to equipment, microprocessors and microcontrollers, and AC signals of other environments. In other instances, well-known structures, devices, and processes are shown in block diagram form, herein, in order to avoid unnecessarily obscuring the present invention.

Figure 1:
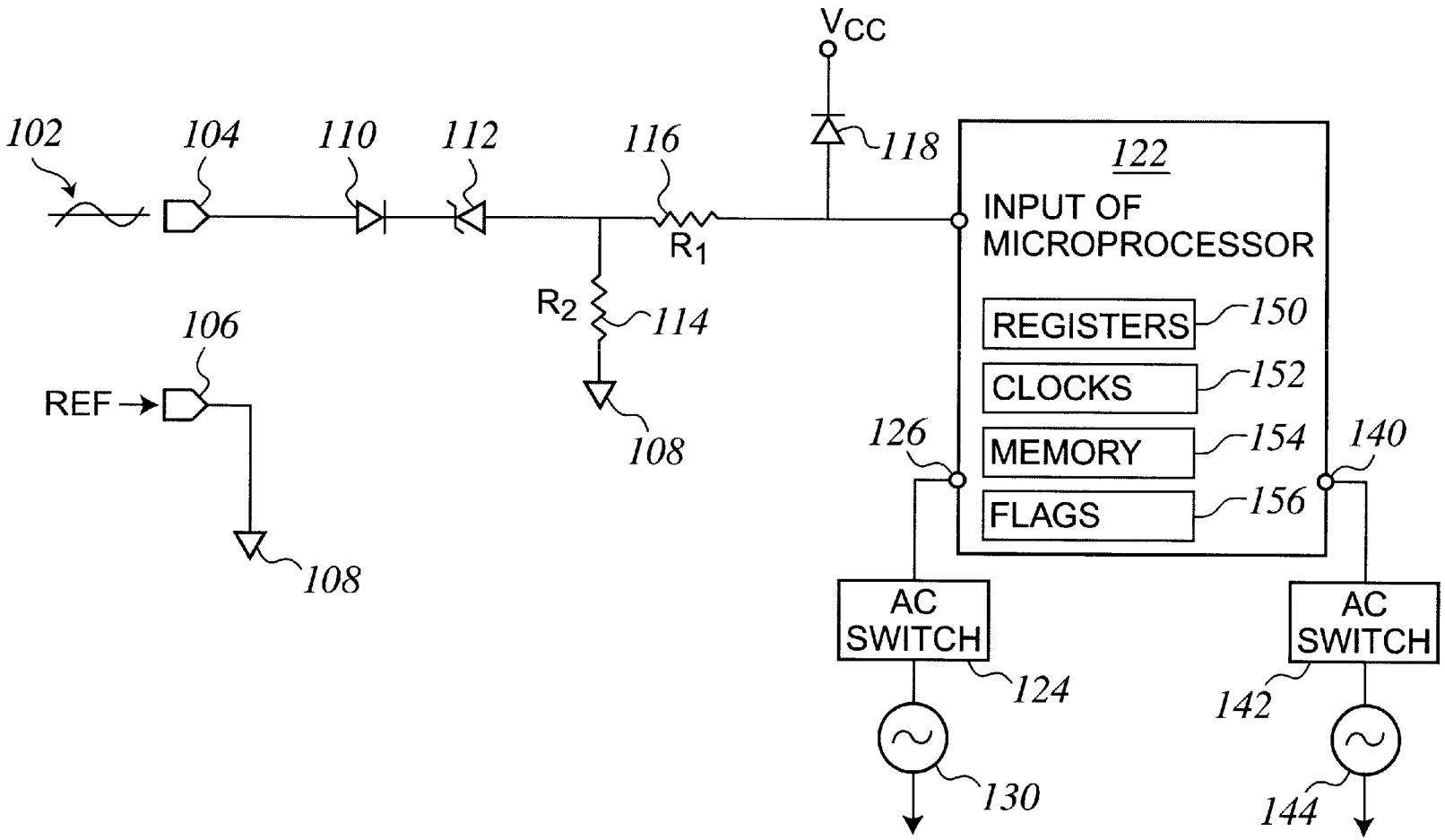
FIG. 1 illustrates an exemplary environment in which an embodiment of the present invention is beneficial.

FIG. 1 illustrates an exemplary environment in which the sampling of an AC switch 124 can be used. As a specific example, the circuitry of FIG. 1 can be part of a heat pump control system. For example, many residential or industrial wall thermostats set and reset switches that control whether or not a 24V AC signal 130 is provided to heating, ventilation and air conditioning (HVAC) equipment. In such an exemplary environment, a microprocessor 122, or microcontroller, determines the state of one of these AC switches 124 by sensing through an input pin 126 whether a 24V AC signal 130 is present on a line connected to the HVAC equipment (not shown). One or more additional AC switches 142, with its own AC signal 144 (or the same signal 130), can be connected to the microcontroller 122, as shown by input pin 140.

In the circuitry of FIG . 1, an AC switch 124 is controlled by some external equipment to be in either an on or off position. Depending on the state of the switch 124, an AC signal 130 is either provided or not provided to the connection point input pin 126. Additionally, an AC line signal 102 is provided to connection point 104. Connection point 106 provides a reference voltage level connected to ground 108. Exemplary clipping and clamping circuitry is illustrated that provides minimal conditioning of the AC line signal 102 to ensure that the voltage levels provided to the input pin 120 of the microcontroller 122 are within prescribed ranges. Appropriate selection of the specific values for the diodes 110, 112 and 118 as well as the resistors 114 and 116 is within the ability of a skilled artisan and depend on the expected voltage levels of the AC line signal 102 as well as the limitations of the input circuitry of the microcontroller 122. The particular illustrated arrangement of the clipping and clamping circuitry is exemplary in nature and other functionally equivalent circuitry can be substituted.

As for the microcontroller or microprocessor 122, these devices typically include registers 150 of various sizes for storing and manipulating data such as counters and status flags, memory 154 for storing data and executable routines, and one or more clocks and interrupts 152 that help control the timing, execution and operation of the microcontroller 122 and its software. Only those portions of the microcontroller 122 useful for sensing the state of the AC switch 124 are depicted in FIG. 1. However, the microcontroller 122 is usually part of a larger system and, therefore, includes input/output pins, memory and software routines sufficient to perform other functions.

Figure 2:
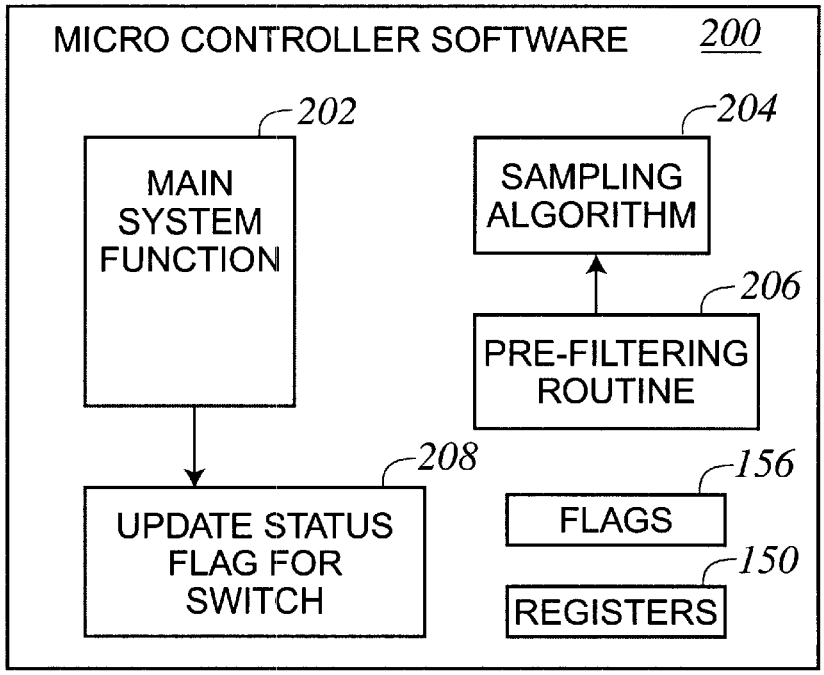
FIG. 2 illustrates a high-level function diagram of exemplary software according to an embodiment of the present invention.

FIG. 2 illustrates a high-level functional view of an embodiment of the present invention. The illustrated functional blocks depict the operation of software routines 200 that execute on the microcontroller 122 for sampling the state of an AC switch 124; in addition, other system software routines 202 are also executed that allow the microcontroller 122 to perform its intended function. Flags 156 and register 150 can be hardware constructs as depicted in FIG. 1, software constructs as depicted in FIG. 2, or a mix of both.

The main software functions 202 of the microcontroller has a function call or other software-type interrupt that triggers the execution of routine 208 to update the status of a flag 156 associated with the state of the switch 124. The sampling algorithm 204 is the actual routine that samples the input pin 126 to determine an instantaneous value related to the state of the switch 124. The flag updating routine 208 utilizes these instantaneous samples to determine whether or not to change the value of the flag 156. A pre-filtering routine 206 generates a periodic interrupt to initiate the execution of the sampling algorithm 204, while the pre-filtering routine 206, itself, is periodically initiated by a hardware interrupt. The detailed operation of these routines is explained below with respect to FIGS. 3-6. Included in the detailed explanations are specific examples and values to aid in the understanding and explanation of the operation of the present invention. These values are merely exemplary in nature and are not meant to limit the scope of the invention.

Figure 3:
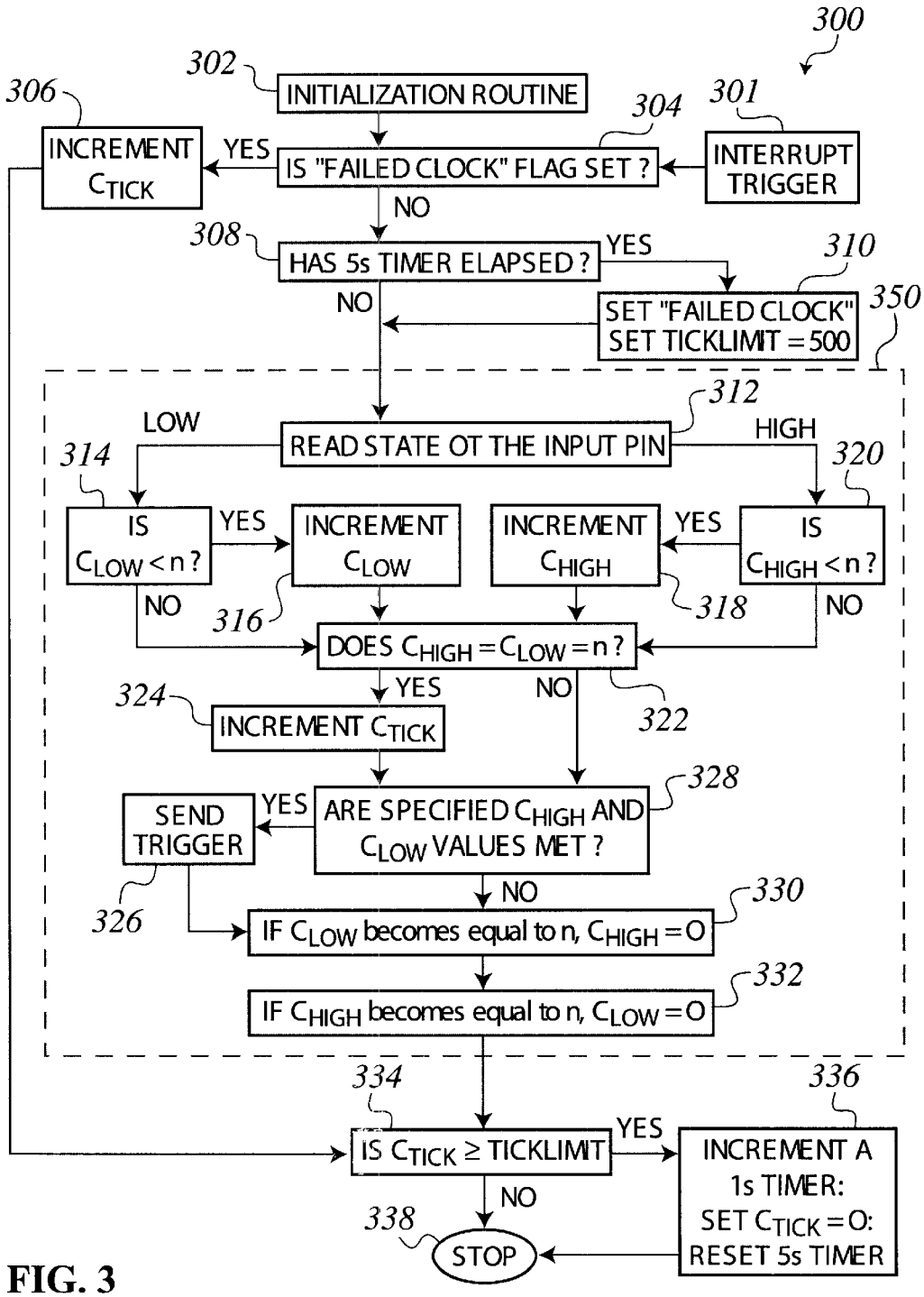
FIG. 3 illustrates a flowchart for prefiltering an AC line signal according to an exemplary embodiment of the present invention.

FIG. 3 depicts a detailed flowchart of the logic for the pre-filtering routine 206. This routine 206 is periodically executed by the microprocessor 122, or microcontroller. For example, the processes of the microcontroller 122 can be interrupted every 1 ms to perform the routine 300. As the calculations within the routine 206 are simple comparisons, the routine 206 can be executed rapidly without adversely affecting the performance of the microcontroller 122. In addition to the internal values maintained by the routine 206, an external trigger 326 is generated, under certain conditions, and provided to initiate other software routines on the microcontroller 122.

Upon the microcontroller 122 receiving a periodic interrupt 301, the routine 206 begins execution at step 304. However, when the microcontroller system is first initialized, such as after a reset or being turned on, an initialization routine 302 is run first. This initialization routine 302 is explained in further detail with regards to FIG. 4. As a result of the initialization routine 302, a timer is started, all the variable flags used by the routine 206 are cleared, and the frequency of the AC line signal 102 is detected. The timer that is started is referred to in the following discussion as "a 5 second timer" and is a relatively long timer that provides the AC line signal 102, in the event of line fluctuations, a time period to stabilize before the routine 206 determines that the AC line signal 102 is unstable. Setting the timer to 5 seconds is an appropriate length of time for many applications, although other times can be selected, as well, as further explained below.

Detecting the frequency of the AC line signal 102 in the initialization routine 302, results in the setting of a variable labeled TICKLIMIT. TICKLIMIT is the number of peaks and troughs in a 1 second period of the AC line signal 102. By defining TICKLIMIT in this way, when a counter that counts peaks and troughs reaches TICKLIMIT, a timing signal indicating the transpiring of 1 second can be generated independent of any clock. For example, if the AC signal has a frequency of 50 Hz, then TICKLIMIT would be set to 100. Similarly, a 60Hz signal would result in TICKLIMIT being set equal to 120.

At step 304, a "Failed Clock" flag is checked to determine whether or not the initialization routine 302 was unable to determine the AC signal's frequency or whether or not the AC line signal 102 has fluctuated to such an extent so as to set the flag (see later step 310). If the flag is set, then a counter, $C_{TICK}$, is incremented in step 306 and control is passed to step 334. Only a very serious issue with the hardware or power line can cause the failed clock event to occur. Under such conditions, the various AC inputs to the microcontroller will likely be corrupt beyond use and, thus, the sampling steps included in the box 350 are effectively disabled while the "Failed Clock" flag is set and require a power reset to once again be operable.

$C_{TICK}$ is the counter which, if the "Failed Clock" flag is clear, keeps a running total of peaks and troughs of the input signal 102. When the "Failed Clock" flag is set, however, $C_{TICK}$ keeps count of the number of times the routine 206 has executed so that when a predetermined limit (i.e., TICKLIMIT) is reached, the counter, $C_{TICK}$, can be reset.

When the "Failed Clock" flag is detected as being "clear" in step 304, control passes to step 308 which checks if the 5 second timer (discussed above) has expired. As long as the AC line signal 102 is well-behaved, a later step (step 336) will periodically restart the 5 second timer. However, if the AC line signal becomes unstable, the 5 second timer will not be reset and eventually elapse, a condition which is detected in step 308.

When the 5 second timer expires, control passes to step 310 which sets the "Failed Clock" flag and sets TICKLIMIT to a predetermined value. As mentioned, TICKLIMIT typically has a value that is dependent on the frequency of the AC line signal 102. However, if the behavior of the AC signal causes the "Failed Clock" flag to be set, then TICKLIMIT is set to a value that does not rely on the AC line signal 102. In the exemplary step 310, TICKLIMIT is set to 500; other values for TICKLIMIT could have also been chosen. For example, if the microcontroller 122 generates an interrupt (step 301) every 2 ms and each execution through routine 206 increments $C_{TICK}$, then 500 executions of $C_{TICK}$ will correspond to 1 second and $C_{TICK}$ can still be used to implement a 1 second timer as before. Accordingly, TICKLIMIT can have a variety a values depending on how often the routine 206 is executed per second. Control passes to step 312 once the "Failed Clock" flag and TICKLIMIT have been set in step 310.

If the AC line signal 102 behaves such that the 5 second timer does not expire, then control passes directly from step 308 to step 312.

In step 312, the state of the input pin 120 is sensed. As a result, the microcontroller 122 determines that the AC line signal 102 is either at logic high or at logic low.

If the AC line signal 102 is at logic low, then flow passes to step 314 which compares a counter $C_{LOW}$ with a predetermined integer, n. $C_{LOW}$ is a counter that keeps a running total of the number of times the sensed AC line signal is at logic low. The integer n is a threshold that determines how large $C_{LOW}$ must be (i.e., how often a low signal is sensed) before determining that a trough has occurred in the AC line signal 102. A small n could result in a trough being detected before it actually occurs; while a large n could result in the trough not being detected until after it has occurred. In the exemplary embodiment of a 50 Hz to 60 Hz signal and a sensing time of approximately every 1 ms, setting n=4 results in detecting the trough within about 10% of its actual occurrence. Different signal frequencies and interrupt triggering frequencies will determine different values for n to maintain accurate trough detection within a 10% window.

If, in step 314, $C_{LOW}$ is less than n; then $C_{LOW}$ is incremented in step 316 and flow passes to step 322. If, in step 314, $C_{LOW}$ is greater than n, then there is no need to increment $C_{LOW}$ and control passes to step 322 (i.e., enough lows have already been counted to indicate a trough occurrence).

If, on the other hand, the AC line signal 102 is at logic high, then flow passes to step 320 which compares a counter $C_{HIGH}$ with the same predetermined integer, n. $C_{HIGH}$ is a counter that keeps a running total of the number of times the sensed AC line signal is at logic high. The integer n is a threshold that determines how large $C_{HIGH}$ must be (i.e., how often a high signal is sensed) before determining that a peak has occurred in the AC line signal 102. A small n could result in a peak being detected before it actually occurs; while a large n could result in the peak not being detected until after it has occurred. In the exemplary embodiment of a 50 Hz to 60 Hz signal and a sensing time of approximately every 1 ms, setting n=4 results in detecting the peak within about 10% of its actual occurrence. Different signal frequencies and interrupt triggering frequencies will determine different values for n to maintain accurate peak detection within a 10% window. While it is possible to use a different n for $C_{LOW}$ than for $C_{HIGH}$, the AC line signal is typically symmetrical, so the n used for $C_{LOW}$ is the same as the n for $C_{HIGH}$.

If, in step 320, $C_{HIGH}$ is less than n; then $C_{HIGH}$ is incremented in step 318 and flow passes to step 322. If, in step 320, $C_{HIGH}$ is more than n, then there is no need to increment $C_{HIGH}$ and control passes to step 322 (i.e., enough highs have already been counted to indicate a peak occurrence).

In step 322, it is determined whether or not both $C_{HIGH}$ and $C_{LOW}$ are both equal to n. If this is the case, then $C_{TICK}$ is incremented, in step 324, and flow continues with step 328. However, if $C_{HIGH}$ and $C_{LOW}$ are not both equal to n, then $C_{TICK}$ remains the same and flow passes directly to step 328.

In step 328, the values of $C_{HIGH}$, and $C_{LOW}$ are compared with predetermined values to determine whether or not to generate an external trigger in step 326. This external trigger is used to initiate the signal sampling routine 204. Although the present invention contemplates that any set of values (less than n) could be used to generate the trigger, in a preferred embodiment, these values are chosen to correspond to a time when the AC line signal 102 is stable. For example, if the predetermined values for $C_{HIGH}$ and $C_{LOW}$ is "3", then the external trigger can be generated when $C_{TICK}$ is incremented in step 324. In such an instance, steps 326 and 328 could be eliminated and step 324 would become a compound step that increments $C_{TICK}$ and generates the trigger.

Continuing with the routine 206 as illustrated in FIG. 3, if, in step 328, the values of $C_{HIGH}$ and $C_{LOW}$ do not indicate that a trigger should be generated, then control continues with step 330.

Steps 330 and steps 332 can be performed in reverse order than that illustrated in FIG. 3. Step 330 determines if $C_{LOW}$ was just incremented to n (in step 316), and if so resets $C_{HIGH}$ to 0. Essentially, this means that when a trough is detected, the $C_{HIGH}$ counter is cleared of any counts from a peak that occurred before the most recent trough so that $C_{HIGH}$ can indicate the next peak as it occurs. $C_{LOW}$ remains equal to n.

Step 332 determines if $C_{HIGH}$ was just incremented to n (in step 320), and if so resets $C_{LOW}$ to 0. Essentially, this means when a peak is detected, the $C_{LOW}$ counter is cleared of any counts from a trough that occurred before the most recent peak so that $C_{LOW}$ can indicate the next trough as it occurs. $C_{HIGH}$ remains equal to n.

By conditioning the generation of a trigger (step 326) on the detection of a signal's peaks and troughs, the above-described steps implement an AC line signal sensing technique which adjusts to the skew of the AC line signal without regard to the operating clock of the microcontroller 122 and without complex zero-crossing circuitry or peak detectors.

By the resetting of $C_{HIGH}$ and $C_{LOW}$ in steps 330 and 332, the occurrence of each successive trough and peak is determined when the condition in step 322 is evaluated to be true and $C_{TICK}$ is incremented. Accordingly, when $C_{TICK}$ =TICKLIMIT, as detected in step 334, it means that 1 second has transpired and the flow of routine 206 continues with step 336. In step 336, the 1 second timer is incremented, $C_{TICK}$ is reset to zero, and the 5 second timer is restarted. Routine 206 is finished at this point and stops at step 338. If $C_{TICK}$ does not equal TICKLIMIT, then control passes from step 334 to step 338 to indicate the end of routine 206.

Figure 4:
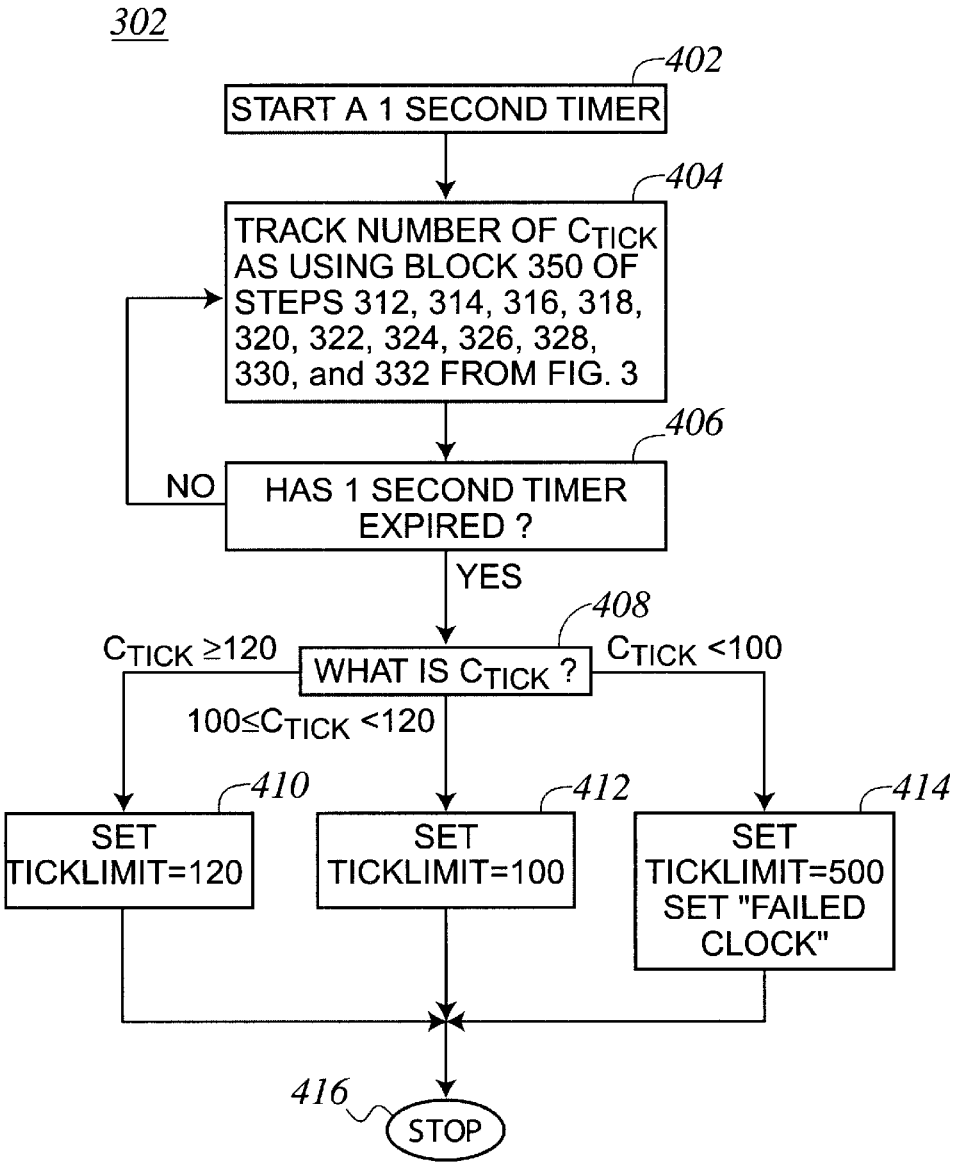
FIG. 4 illustrates a flowchart for an exemplary initializing routine for the prefiltering embodiment of FIG. 3.

FIG. 4 shows a flowchart with a more detailed view of the initialization routine 302. This step determines the frequency of the AC line signal 102 and, as a result, sets TICKLIMIT appropriately.

During start up of the microcontroller 122 (such as after a reset), a 1 second timer is started in step 402. In step 404, a counter $C_{TICK}$ is used to maintain a running count of the number of peaks and troughs in the AC line signal 102. The method for updating $C_{TICK}$ is the same technique described earlier with respect to those steps included in the box 350 of FIG. 3 (i.e., steps 312–332). In step 406, the 1 second timer is tested to see if it has expired. If the timer has not expired, then control returns to step 404 so that $C_{TICK}$ can be updated. If, however, the timer has expired, then no more peaks or troughs are counted and flow continues with step 408. In step 408, the value of $C_{TICK}$ is used to appropriately set TICKLIMIT in steps 4120, 412 and 414. In step 414, the "FAILED CLOCK" flag is set, as well. The initialization routine 302 stops with step 316.

The trigger generated in step 326 is used to initiate an interrupt that starts a software routine 500 that samples the microcontroller input 126 to detect the state of the AC switch 124. For a 60 Hz AC line signal 102, this trigger occurs about once every 8.33 ms.

Figure 5:
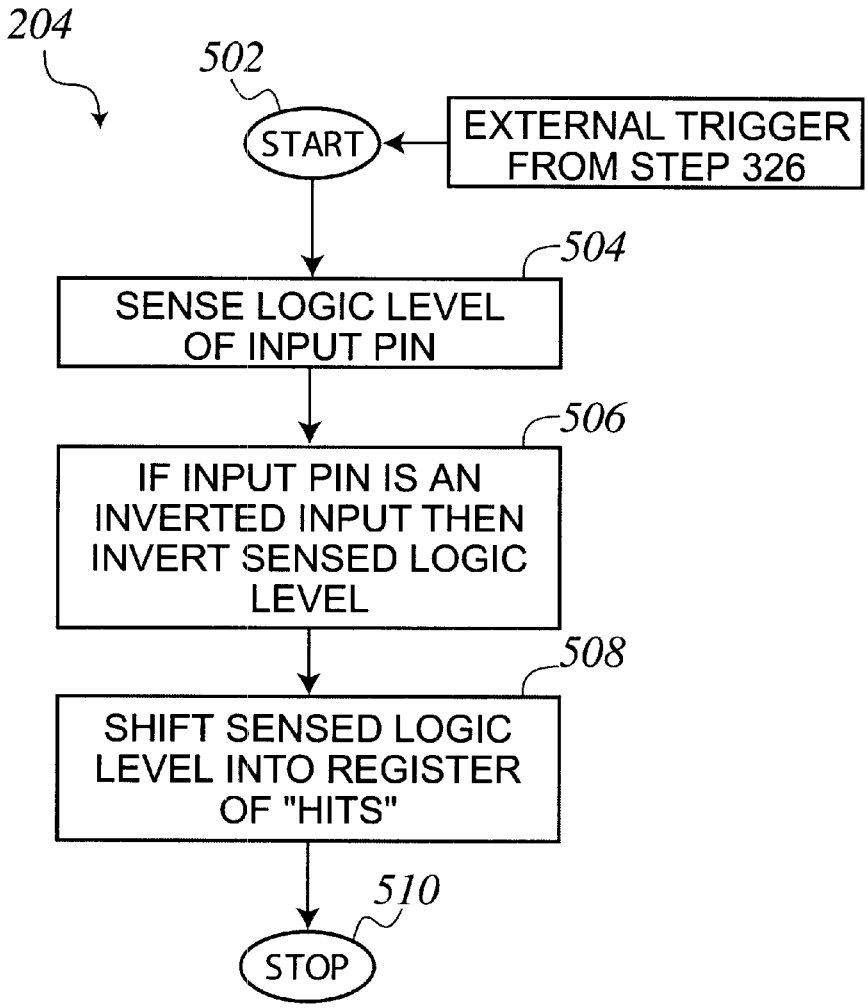
FIG. 5 illustrates a flowchart for an exemplary signal sensing routine according to an embodiment of the present invention.

FIG. 5 illustrates a flowchart of one embodiment for using the trigger to sample the switch 124.

When the external trigger starts (step 502), flow of routine 204 continues with step 504. In step 504, the logic level of the input pin 126 is sensed. This input represents the AC signal 130 if the switch 124 is closed and represents a ground voltage level if the switch 124 is open. The AC signal 130 may not be within the input voltage range of the input pin 126. Accordingly, minimal conditioning equipment (not shown) can be included to limit the AC signal 130 to acceptable voltage levels.

Some input pins on various microcontrollers are inverted logic inputs and the present invention could handle such a circumstance, in step 506, by inverting the sensed logic level if needed. For example, a flag could be set in the software program which implements routine 500 to indicate whether or not the input pin is inverted logic or not.

The logic level (or the inverted logic level) that is sensed is shifted into a shift register (see FIG. 1) associated with input pin 126. The length of the shift register 150 can be a variety of different lengths. Continuing with the exemplary embodiment described above, a shift register of 16 bits is of sufficient size to accurately reflect the state of the sensed AC signal 130. The shift register 150, of length x, essentially reflects the last x values of the sensed signal 130, in terms of "1s" (sensed logic HIGH) and "0s" (sensed logic LOW). The longer the shift register 150, the longer processing and evaluations will take. The shorter the shift register 150, however, the more likely an error will be made when evaluating whether the switch 124 is open or closed.

The microcontroller 122 is typically part of a larger system, for example, an HVAC system as described in the earlier exemplary embodiments. As part of such a system, the microcontroller 122 has a main system software routine that runs. The system software routine may have a need to determine some condition about the switch 124. For example, the system may determine if the switch has cycled on or off in a predetermined time frame in order to prevent over-cycling a device controlled by the switch. Accordingly, the system software will maintain a flag 156 that indicates the last known value for the state of the switch 124. The system software routine includes a mechanism for periodically updating this flag's value.

Figure 6:
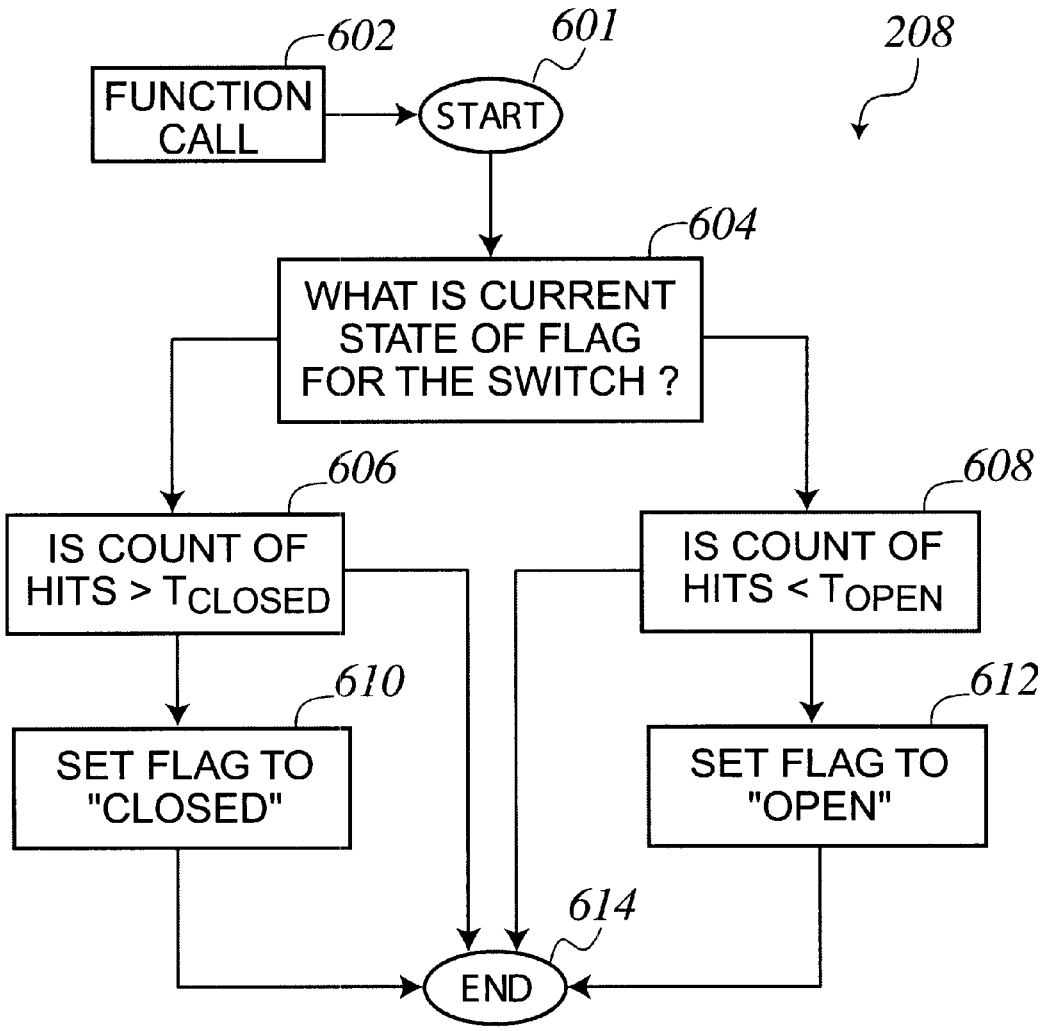
FIG. 6 illustrates a flowchart for an exemplary routine for updating the state of a switch according to an embodiment of the present invention.

FIG. 6 illustrates a flowchart of an exemplary routine 208 for updating the value of a switch's status flag 156. A function call or software interrupt, in step 602, from the main system software can initiate the start of the routine, in step 601.

In step 604, the current status of the flag is retrieved indicating whether the switch 124 is thought to be closed or open. If the switch 124 is thought to be open, then the logical flow continues with step 606. If, however, the switch 124 is thought to be closed, then the flow continues with step 608.

In step 606, the contents of the shift register 150 are added together to effectively determine, out of the last x samples, how often was the sensed signal HIGH (where "x" is the length of the shift register 150). If this count (or sum) is greater than a predetermined threshold, $T_{CLOSED}$, then the switch 124 is considered to now be closed and the flag 156 is appropriately set in step 610 to reflect the new state of the switch 124.

In step 608, also, the contents of the shift register 150 are added together to effectively determine, out of the last x samples, how often was the sensed signal HIGH. If this count is less than a predetermined threshold, $T_{OPEN}$, then the switch 124 is considered to now be open and the flag 156 is appropriately set in step 612 to reflect the new state of switch 124.

If the AC signal 130 is present at the input pin 126 (i.e., the AC switch 124 is closed), then the shift register 150 will have a fair distribution of both "1s" and "0s". If the switch 124 is open, however, then the shift register 150 will reflect an ever-increasing number of "0s". The setting of the thresholds $T_{OPEN}$ and $T_{CLOSED}$ control how quickly the flag 156 will change values after the switch 124 changes state. As a result, the routine 601 permits implementation of variable hysteresis, or filtering level, in controlling the switch status flag 156.

For example, after the switch 124 has been open for a relative long time, the register 150 will be all "0s". The value for $T_{CLOSED}$ will determine how many "1s" it will take, after the switch 124 is closed, before the flag 156 is changed to reflect the switch's new state. Similarly, $T_{OPEN}$ will control how many "0s" must be sensed, once the switch 124 is opened, before the flag 156 is changed to reflect the switch's new state. In the exemplary embodiment described herein, with the parameters as previously described, preferred threshold values are $T_{OPEN}$=3 and $T_{CLOSED}$=6. These values provide a good balance between responsiveness and accuracy. The higher $T_{CLOSED}$ is, the longer the hysteresis is; however, immunity to false CLOSED triggering is improved. The lower $T_{OPEN}$ is, the longer the hysteresis is; however, immunity to false OPEN triggering is improved. The preferred values implement a sampling method that has relatively fast response to changes in the AC signal while largely eliminating false switching caused by transients, dropped line cycles, and brown-outs.

Regardless of whether or not the status flag 124 is changed, the flow of routine 208 completes with step 614.

Although FIGS. 5 and 6 are described above as sampling only a single input pin for a single switch, the exemplary embodiment can be expanded to include multiple input pins. For each such input pin, a separate register is advantageous as well as a separate status flag.

An AC switch sampling method has been described that can be accomplished by a microcontroller, which provides variable hysteresis levels and eliminates false switching. The method can be performed by a microcontroller because of its efficiency in having the inputs sampled by an interrupt process and the computations performed at a later point during program execution. This efficiency provides the capacity to determine the "on" and "OFF" state of a large number of switches simultaneously. Furthermore, the computations are extremely simple, lending the method to application in the most basic of microcontrollers. The method include a software pre-filtering scheme that increases the sensing reliability without the addition of complex circuitry and provides phase angle shift independence.

While this invention has been described in connection with what is presently considered to be the most practical and preferred embodiment, it is to be understood that the invention is not limited to the disclosed embodiment, but on the contrary, is intended to cover various modifications and equivalent arrangements included within the spirit and scope of the appended claims. The invention is capable of other and different embodiments and its several details are capable of modifications in various obvious respects, all without departing from the invention. Accordingly, the drawings and description are to be regarded as illustrative in nature, and not as restrictive.

What is claimed is:

1. A method for detecting the presence of one or more alternating current (AC) signals each on a respective line comprising the steps of:

for each particular one of the AC signals and respective lines:

(a) receiving a trigger signal (326) corresponding to a trough or peak of the particular AC signal (130);

(b) sampling (504) the particular respective line in response to the trigger signal (326) to generate a current binary value;

(c) combining the current binary value with a set of previously generated binary values for the particular respective line to form combined binary values (508), and (d) determining whether or not the particular AC signal (130) is present on the particular respective line based on the combined binary values (508).

2. The method according to claim 1, further comprising the step of:

(e) determining the state of an AC switch (124) associated with the particular respective line based on whether or not the particular AC signal (130) is determined to be present on the particular respective line.

3. The method according to claim 2, further comprising the step of:

(f) setting an indicator (610 and 612) according to the determined state of the AC switch (124).

4. The method according to claim 3, wherein the step of determining whether or not the particular AC signal (130) is present is further based on a value of the indicator (610 and 612).

5. The method according to claim 1, wherein the trigger signal occurs within a predetermined temporal window of each trough and peak.

6. The method according to claim 5, wherein the temporal window is substantially 10% of a period of the particular AC signal (130).

7. The method according to claim 1, wherein the step of combining further includes the steps of:

(c.1) storing n previous binary values for the particular respective line, where n is a positive integer; and (c.2) combining the current binary value with n−1 of the n previous binary values thereby eliminating an oldest one of the n previous binary values (508).

8. The method according to claim 1, wherein the step of determining further includes the steps of:

(d.1) comparing (606) a sum of the combined binary values (508) to a predetermined threshold; and (d.2) determining (610) that the particular AC signal (130) is present when the sum is greater than the predetermined threshold.

9. The method according to claim 8, further comprising the step of:

(d.3) increasing a period of time needed to determine that the particular AC signal is present by increasing the predetermined threshold.

10. The method according to claim 8, further comprising the step of:

(d.3) decreasing the likelihood of falsely determining that the particular AC signal is present by increasing the predetermined threshold.

11. The method according to claim 1, wherein the step of determining further includes the steps of:

(d.1) comparing (608) a sum of the combined binary values (508) to a predetermined threshold; and (d.2) determining (612) that the particular AC signal (130) is not present when the sum is less than the predetermined threshold.

12. The method according to claim 11, further comprising the step of:

(d.3) increasing a period of time needed to determine that the particular AC signal is present by decreasing the predetermined threshold.

13. The method according to claim 11, further comprising the step of:

(d.3) decreasing the likelihood of falsely determining that the particular AC signal is not present by decreasing the predetermined threshold.

14. The method according to claim 1, further comprising the steps of:

(e) complementing (506) the current binary value (504) if the step of sampling is performed using inverted logic;

(f) combining the complemented current binary value (504) with a set of previously generated complemented binary values (508) for the particular respective line, and (g) determining whether or not the particular AC signal is present on the particular respective line based on the combined complemented binary values (508).

15. The method according to claim 1, further comprising the step of:

repeating steps (a)–(d) for each of a plurality of sequentially received trigger signals.

16. The method according to claim 1, wherein the step of receiving a trigger signal further includes the steps of:

(a) sensing (312) the state of an AC line signal (102);

(b) determining whether the state of the AC line signal (102) corresponds to a logic high state or a logic low state;

(c) when the state of the AC line signal (102) is determined to correspond to a logic low state, incrementing (316) a first counter if doing so would not increment the first counter above a predetermined threshold (314);

(d) when the state of the AC line signal (102) is determined to correspond to a logic high state, incrementing (318) a second counter if doing so would not increment the second counter above the predetermined threshold (320);

(e) if both first and second counters are equal to the predetermined threshold (322), then generating the trigger signal (326).

17. A method for providing a trigger signal synchronized with a peak or trough of an AC signal (102) comprising the steps of:

(a) sensing (312) the state of a first line connected with the AC signal (102);

(b) determining whether the state of the first line corresponds to a logic high state or a logic low state;

(c) when the state of the first line is determined to correspond to a logic low state, incrementing (316) a first counter if doing so would not increment the first counter above a predetermined threshold (314);

(d) when the state of the first line is determined to correspond to a logic high state, incrementing (318) a second counter if doing so would not increment the second counter above the predetermined threshold (320);

(e) if both first and second counters are equal to the predetermined threshold (322), then generating the trigger signal (326).

18. The method according to claim 17, further comprising the steps of:

(f) if the first counter is incremented to become equal to the threshold, then setting the second counter equal to zero (330); and (g) if the second counter is incremented to become equal to the threshold, then setting the first counter equal to zero (332).

19. The method according to claim 17, further comprising the step of:

(f) in response to the trigger signal (326), sampling (504) a second line to determine whether or not an associated AC signal (130) is present on the second line.

20. The method according to claim 17, further comprising the steps of:

(f) repeating steps (a)–(e) at periodic intervals to generate a plurality of trigger signals; and (g) in response to each of the trigger signals, sampling one or more second lines to generate a series of respective binary values for each second line, wherein each of the one or more second lines is associated with a respective AC signal; and (h) determining whether or not the respective AC signal is present on the associated second line based on a subset of the series of binary values for that second line.

21. The method according to claim 17, further comprising the steps of:

(f) repeating steps (a)–(e) for a unit time period;

(g) counting (408) the number of trigger signals generated during the unit time period (406); and (h) calculating the frequency of the AC signal, in terms of the unit time period, based on the counted number of trigger signals.

22. Method according to claim 17, further comprising the step of:

(f) selecting the predetermined threshold such that the generated trigger signal occurs within a predetermined temporal window of the trough or peak of the AC signal.

23. The method according to claim 22, wherein the temporal window is substantially 10% of a period of the particular AC signal.

24. An apparatus for detecting the state of an AC switch, comprising:

a first input (126) configured to be connected with a first input line switchably connected with a first AC signal (130) through a first switch (124);

trigger generating circuitry (206) configured to generate a trigger signal corresponding to a trough or peak of the first AC signal (130);

first sensing circuitry configured to sense (204) a current logic level of the first input (126);

a first memory (150) configured to store a combination of the current sensed logic level and a plurality of previously sensed logic levels; and a comparator (606 and 608) configured to determine whether or not the first AC signal (130) is present on the first input line based on a comparison of the combination of logic levels with a predetermined threshold.

25. The apparatus according to claim 24, further comprising:

a second input (140) configured to be connected with: a second input line switchably connected with a second AC signal (144) through a second switch (142);

second sensing circuitry (204) configured to sense a current logic level of the second input;

a second memory (150) configured to store a combination of the current logic level of the second input and a plurality of previously sensed logic levels of the second input; and the comparator (606 and 608) further configured to determine whether or not the second AC signal (144) is present on the second input line based on a comparison of the combination of logic levels of the second input with the predetermined threshold.

26. The apparatus according to claim 24, further comprising:

an inverter (506) configured to complement the current logic level if the first input uses inverted logic.

27. The apparatus according to claim 24, wherein the first memory further comprises:

a shift register (508) of n bits configured to store the current sensed logic level and the previous n−1 sensed logic levels, and wherein the comparator is configured to sum all the logic levels in the shift register (508) and compare the sum to the predetermined threshold.

28. The apparatus according to claim 24, wherein the state of the first switch (124) is determined based on the determination of whether or not the first AC signal (130) is present on the first input line.

* * * * *